US010222183B2

(12) United States Patent
Smith

(10) Patent No.: US 10,222,183 B2
(45) Date of Patent: Mar. 5, 2019

(54) LEAD-FREE RIMFIRE PROJECTILE

(71) Applicant: Timothy G. Smith, St. Marys, PA (US)

(72) Inventor: Timothy G. Smith, St. Marys, PA (US)

( * ) Notice: Subject to any disclaimer, the term of this patent is extended or adjusted under 35 U.S.C. 154(b) by 0 days.

(21) Appl. No.: 15/057,785

(22) Filed: Mar. 1, 2016

(65) Prior Publication Data

US 2016/0258724 A1 Sep. 8, 2016

Related U.S. Application Data

(60) Provisional application No. 62/126,772, filed on Mar. 2, 2015.

(51) Int. Cl.

| | |
|---|---|
| ***F42B 12/74*** | (2006.01) |
| ***F42B 5/32*** | (2006.01) |
| ***B22F 1/00*** | (2006.01) |
| ***B22F 5/10*** | (2006.01) |
| ***C22C 9/02*** | (2006.01) |
| ***F42B 33/00*** | (2006.01) |
| ***F42B 10/42*** | (2006.01) |
| *B22F 3/16* | (2006.01) |
| *F42B 14/02* | (2006.01) |
| *B22F 3/02* | (2006.01) |
| *B22F 3/03* | (2006.01) |
| *C22C 1/04* | (2006.01) |

(52) U.S. Cl.

CPC ..... *F42B 5/32* (2013.01); *B22F 1/0062* (2013.01); *B22F 5/106* (2013.01); *C22C 9/02* (2013.01); *F42B 10/42* (2013.01); *F42B 12/74* (2013.01); *F42B 33/00* (2013.01); *B22F 3/02* (2013.01); *B22F 3/03* (2013.01); *B22F 3/16* (2013.01); *B22F 2301/10* (2013.01); *B22F 2302/45* (2013.01); *B22F 2998/10* (2013.01); *C22C 1/0425* (2013.01); *F42B 14/02* (2013.01)

(58) Field of Classification Search

CPC ..... F42B 12/72; F42B 12/74; F42B 12/745; F42B 12/76; F42B 12/78

USPC ..... 102/514, 516, 519

See application file for complete search history.

(56) References Cited

U.S. PATENT DOCUMENTS

| | | | |
|---|---|---|---|
| 2,409,307 | A | 10/1946 | Patch et al. |
| 3,611,937 | A | 10/1971 | Hildebrand |
| 4,109,582 | A | 8/1978 | Haep et al. |

(Continued)

FOREIGN PATENT DOCUMENTS

| | | | |
|---|---|---|---|
| CN | 2370382 | Y | 3/2000 |
| DE | 100 43 819 | * | 3/2001 |

(Continued)

*Primary Examiner* — Stephen Johnson

(74) *Attorney, Agent, or Firm* — The Webb Law Firm

(57) ABSTRACT

A projectile includes a nose portion with a tapered proximal portion and a rounded distal portion, an end of the tapered proximal portion having a first diameter. The projectile has a body portion substantially cylindrical in shape having a second diameter. A first end of the body portion is adjacent to the tapered proximal portion of the nose portion. The projectile has a heel portion substantially cylindrical in shape having a third diameter. A first end of the heel portion is adjacent to a second end of the body portion. The second diameter is greater than the third diameter. The projectile also has a depression defined in a second end of the heel portion. A rimfire ammunition and a method of manufacturing a projectile are also disclosed.

20 Claims, 11 Drawing Sheets

(56) References Cited

U.S. PATENT DOCUMENTS

| | | | | |
|---|---|---|---|---|
| 4,130,061 | A | 12/1978 | Boggs et al. | |
| 4,480,551 | A | 11/1984 | LoFiego | |
| 4,797,985 | A | 1/1989 | Prochnow et al. | |
| 4,841,856 | A | 6/1989 | Gisler et al. | |
| 5,020,439 | A | 6/1991 | Winter et al. | |
| 5,127,332 | A | 7/1992 | Corzine et al. | |
| 5,443,010 | A * | 8/1995 | Dahlitz | F42B 14/04 102/501 |
| 5,490,463 | A | 2/1996 | Lamberty et al. | |
| 5,495,819 | A | 3/1996 | Marion | |
| 5,518,268 | A | 5/1996 | Moore et al. | |
| 5,533,751 | A | 7/1996 | Kort et al. | |
| 5,877,437 | A | 3/1999 | Oltrogge | |
| 5,945,629 | A | 8/1999 | Schildknecht et al. | |
| 6,016,754 | A | 1/2000 | Enlow et al. | |
| 6,074,454 | A | 6/2000 | Abrams et al. | |
| 6,090,178 | A | 7/2000 | Benini | |
| 6,174,494 | B1 | 1/2001 | Lowden et al. | |
| 6,182,574 | B1 | 2/2001 | Giannoni | |
| 6,263,798 | B1 | 7/2001 | Benini | |
| 6,324,985 | B1 * | 12/2001 | Petrusha | F42B 12/74 102/514 |
| 6,354,222 | B1 | 3/2002 | Becker et al. | |
| 6,546,875 | B2 | 4/2003 | Vaughn et al. | |
| 6,551,375 | B2 | 4/2003 | Siddle et al. | |
| 6,551,376 | B1 | 4/2003 | Beal | |
| 6,591,730 | B2 | 7/2003 | Beal | |
| 6,629,485 | B2 | 10/2003 | Vaughn et al. | |
| 6,837,165 | B2 * | 1/2005 | Eberhart | F42B 12/74 102/510 |
| 6,840,149 | B2 | 1/2005 | Beal | |
| 6,959,648 | B2 * | 11/2005 | Piela | F42B 5/025 102/511 |
| 7,243,588 | B2 | 7/2007 | Beal | |
| 7,555,987 | B2 | 7/2009 | Powers, Jr. | |
| 7,685,942 | B1 | 3/2010 | Powers, Jr. | |
| 7,802,393 | B2 | 9/2010 | Judson et al. | |
| 8,028,626 | B2 | 10/2011 | Hash et al. | |
| 8,171,851 | B2 * | 5/2012 | Siddle | C22C 27/04 102/506 |
| 8,312,815 | B1 | 11/2012 | Joys et al. | |
| 8,448,927 | B1 | 5/2013 | Falabella et al. | |
| 9,702,679 | B2 | 7/2017 | Smith et al. | |
| 2004/0016356 | A1 | 1/2004 | Jopson et al. | |
| 2004/0244629 | A1 | 12/2004 | Jopson | |
| 2005/0066848 | A1 | 3/2005 | Muskat et al. | |

FOREIGN PATENT DOCUMENTS

| | | | |
|---|---|---|---|
| FR | 2364427 | A1 | 4/1978 |
| WO | 0120246 | A1 | 3/2001 |

* cited by examiner

LEAD-FREE RIMFIRE PROJECTILE

CROSS REFERENCE TO RELATED APPLICATIONS

This application claims priority to U.S. Provisional Patent Application No. 62/126,772 filed on Mar. 2, 2015, the disclosure of which is hereby incorporated in its entirety by reference.

BACKGROUND OF THE INVENTION

Field of the Invention

The present invention relates to a projectile, and in particular a lead-free projectile for use in a rimfire cartridge, a rimfire ammunition including the same, and a method of manufacturing the projectile.

Description of Related Art

Projectiles, including bullets, shots, and pellets are manufactured using a variety of materials, including metals. Many such materials contain or include lead. However, the use of lead has decreased due to well-documented environmental impacts, and the use of lead-based ammunition has been increasingly regulated in many states and countries. New, more-restrictive lead bans have placed an emphasis on developing lead-free projectiles and ammunition that represent cost effective alternatives as compared to those that are presently available. These developments have led to manufacturers seeking alternative materials to replace lead-based projectiles.

Generally, a projectile is fired from a cartridge containing a priming compound. In operation, the priming compound sparks to ignite the gunpowder. Rimfire cartridges contain this priming compound in the rim of the cartridge, and the firing pin hits the rim of the cartridge to spark the priming compound. In contrast, centerfire cartridges oftentimes include a circular primer in the center of the base of the cartridge. The firing pin, in this case, hits the center primer, as opposed to the rim of the cartridge, to spark the priming compound to ignite the gunpowder.

Lead-free centerfire ammunition has been available and in use for many years. However, current lead-free rimfire ammunition, while in existence, is either less effective or too expensive to be a reasonable alternative to conventional lead rimfire ammunition. The lack of effective and affordable lead-free rimfire ammunition leads to lead-free rimfire ammunition being too costly to be a reasonable option in places where lead is banned.

Therefore, there is a need in the art to provide a lead-free, rimfire projectile that is both cost effective to produce and highly accurate to use.

SUMMARY OF THE INVENTION

Accordingly, provided are an improved projectile, rimfire ammunition including such a projectile, and method of manufacturing such a projectile.

According to one preferred and non-limiting embodiment or aspect, provided is a projectile including a nose portion with a tapered proximal portion and a rounded distal portion, an end of the tapered proximal portion having a first diameter. The projectile also has a body portion substantially cylindrical in shape having a second diameter. A first end of the body portion is adjacent to the tapered proximal portion of the nose portion. The projectile also has a heel portion substantially cylindrical in shape having a third diameter. A first end of the heel portion is adjacent to a second end of the body portion. The second diameter is greater than the third diameter. The projectile also has a depression defined in a second end of the heel portion.

In one preferred and non-limiting embodiment or aspect, the projectile is lead-free. The projectile can be configured to fit in a cartridge of a rimfire ammunition. The projectile can include copper or a copper-based alloy. The projectile can include copper and tin. The projectile can include 89-90 weight % copper and 9.5-10 weight % tin, based on the total weight of the projectile. The projectile can have a density of 7-8 g/cm$^3$. The projectile can have a maximum depth of the depression of 40-135% of a length of the nose portion. The projectile can have a maximum diameter of the depression of at least 33% of the third diameter. The projectile can have the first diameter 1-30% smaller than the second diameter. The projectile can have the third diameter 1-20% smaller than the second diameter. The projectile can have a length of the heel portion 10-30% of a length of the body portion. The projectile can have a length of the nose portion 90-220% of a length of the body portion.

In one preferred and non-limiting embodiment or aspect, provided is a rimfire ammunition having a cartridge casing with an open front end and a closed back end. The rimfire ammunition also has a priming compound provided at a rim at the back end of the cartridge casing. The rimfire ammunition includes a projectile adapted to fit in the open front end of the cartridge casing, and the projectile includes a nose portion with a tapered proximal portion and a rounded distal portion, an end of the tapered proximal portion having a first diameter. The projectile also has a body portion substantially cylindrical in shape having a second diameter. A first end of the body portion is adjacent to the tapered proximal portion of the nose portion. The projectile also has a heel portion substantially cylindrical in shape having a third diameter. A first end of the heel portion is adjacent to a second end of the body portion. The second diameter is greater than the third diameter. The projectile also has a depression defined in a second end of the heel portion.

In one preferred and non-limiting embodiment or aspect, provided is a method of manufacturing a projectile including: (a) providing a tooling comprising: a die defining an interior passageway, a lower punch positioned in the interior passageway and movable between a first position and a second position, and an upper punch movable between a first position with the upper punch outside of the interior passageway and a second position with the upper punch at least partially inside the interior passageway; (b) providing at least one metal powder to the interior passageway; (c) moving the upper punch to the second position of the upper punch; (d) moving the lower punch to the second position of the lower punch to compact the powder to form a projectile; and (e) sintering the projectile.

In one preferred and non-limiting embodiment or aspect, the method further includes: (f) after step (d), moving the upper punch and lower punch simultaneously to final molding heights, wherein 10-60 tons per square inch of pressure is applied to further compact the projectile. In the method, the powder can include copper or a copper-based alloy or tin, or a combination thereof. The powder can include copper and tin. The powder can include a wax-based atomized lubricant. The sintering step of the method can be a liquid phase sintering process.

Further embodiments or aspects will now be described in the following numbered clauses.

Clause 1: A projectile comprising: a nose portion comprising a tapered proximal portion and a rounded distal portion, an end of the tapered proximal portion having a first diameter; a body portion substantially cylindrical in shape having a second diameter, wherein a first end of the body portion is adjacent to the tapered proximal portion of the nose portion; a heel portion substantially cylindrical in shape having a third diameter, wherein a first end of the heel portion is adjacent to a second end of the body portion; and a depression defined in a second end of the heel portion.

Clause 2: The projectile of clause 1, wherein the projectile is lead-free.

Clause 3: The projectile of clause 1 or 2, wherein the projectile is configured to fit in a cartridge of rimfire ammunition Clause 4: The projectile of any of clauses 1-3, wherein the projectile comprises copper or a copper-based alloy.

Clause 5: The projectile of any of clauses 1-4, wherein the projectile comprises copper and tin.

Clause 6: The projectile of any of clauses 1-5, wherein the projectile comprises 89-90 weight % copper and 9.5-10 weight % tin, based on the total weight of the projectile.

Clause 7: The projectile of any of clauses 1-6, wherein the projectile has a density of 7-8 g/cm$^3$.

Clause 8: The projectile of any of clauses 1-7, wherein a maximum depth of the depression is 40-135% of a length of the nose portion, preferably the maximum depth of the depression is 45-130% of the length of the nose portion.

Clause 9: The projectile of any of clauses 1-8, wherein a maximum diameter of the depression is at least 33% of the third diameter, preferably the maximum diameter of the depression is 75-90% of the third diameter.

Clause 10: The projectile of any of clauses 1-9, wherein the first diameter is 0-30% smaller than the second diameter, preferably the first diameter is 1-30% smaller than the second diameter, more preferably the first diameter is 10-20% smaller than the second diameter.

Clause 11: The projectile of any of clauses 1-10, wherein the third diameter is 1-20% smaller than the second diameter, preferably the third diameter is 5-15% smaller than the second diameter.

Clause 12: The projectile of any of clauses 1-11, wherein a length of the heel portion is 10-30% of a length of the body portion, preferably the length of the heel portion is 15-25% of the length of the body portion.

Clause 13: The projectile of any of clauses 1-12, wherein a length of the nose portion is 90-220% of a length of the body portion, preferably the length of the nose portion is 100-205% of the length of the body portion.

Clause 14: A rimfire ammunition comprising: a cartridge casing having an open front end and a closed back end; a priming compound provided at a rim at the back end of the cartridge casing; and a projectile according to any of clauses 1-13 adapted to fit in the open front end of the cartridge casing.

Clause 15: A method of manufacturing a projectile comprising: (a) providing a tooling comprising: a die defining an interior passageway, a lower punch positioned in the interior passageway and movable between a first position and a second position, and an upper punch movable between a first position with the upper punch outside of the interior passageway and a second position with the upper punch at least partially inside the interior passageway; (b) providing at least one metal powder to the interior passageway; (c) moving the upper punch to the second position of the upper punch; (d) moving the lower punch to the second position of the lower punch to compact the powder to form a projectile; and (e) sintering the projectile.

Clause 16: The method of clause 15, further comprising: (f) after step (d), moving the upper punch and lower punch simultaneously to final molding heights, wherein 10-60 tons per square inch of pressure is applied, preferably 30-45 tons per square inch of pressure is applied, more preferably 40-45 tons per square inch of pressure is applied to further compact the projectile.

Clause 17: The method of clause 15 or 16, wherein the powder comprises at least one of the following: copper, a copper-based alloy, tin, or any combination thereof.

Clause 18: The method of any of clauses 15-17, wherein the powder comprises copper and tin.

Clause 19: The method of any of clauses 15-18, wherein the powder further comprises a wax-based atomized lubricant.

Clause 20: The method of any of clauses 15-19, wherein the sintering step is a liquid phase sintering process.

Clause 21: The method of any of clauses 15-20, wherein the sintering step is a solid phase sintering process.

Clause 22: The method of any of clauses 15-21, wherein the lower punch comprises a convex end.

Clause 23: The method of any of clauses 15-22, wherein the upper punch comprises a concave end.

Clause 24: The method of any of clauses 17-23, wherein the copper-based alloy is made predominately of copper and includes at least one of the following: tin, zinc, aluminum, manganese, silicon, or any combination thereof.

Clause 25: The method of any of clauses 15-24, wherein the powder further comprises an additive, such as a chemical compound, a polymeric compound, and a binder.

Clause 26: The method of any of clauses 15-25, wherein the powder is made of separate metal powders mixed in a desired ratio and blended.

Clause 27: The method of any of clauses 15-26, wherein the powder is blended along with a wax-based lubricant.

Clause 28: The method of any of clauses 15-27, wherein the powder is blended for 20-30 minutes.

Clause 29: The projectile of any of clauses 1-13, wherein the copper-based alloy is made predominately of copper and includes at least one of the following: tin, zinc, aluminum, manganese, silicon, or any combination thereof.

Clause 30: The projectile of any of clauses 1-13, wherein the second diameter is greater than the first diameter.

These and other features and characteristics of the present invention, as well as the methods of operation and functions of the related elements and structures and the combinations of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and claims, the singular form of "a", "an", and "the" include plural referents unless the context clearly dictates otherwise. Preferred features will be elucidated in the claims and in the specific description of the embodiments that follow. It will be readily appreciated that the preferred features of certain embodiments could be usefully incorporated in other described embodiments even if not specifically described in those terms herein.

DESCRIPTION OF THE INVENTION

Figure 1:
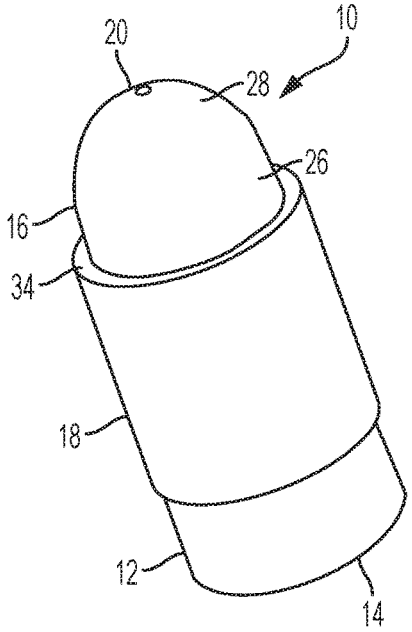
FIG. 1 is a top perspective view of a projectile according to the principles of the present invention.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. It is to be understood that the invention can assume various alternative variations and step sequences, except where expressly specified to the contrary. It is also to be understood that the specific devices and processes illustrated in the attached drawing figures, and described in the following specification, are simply exemplary embodiments of the invention. Hence, specific dimensions or other physical characteristics related to the embodiments disclosed herein are not considered as limiting. Where a range is given, it is to be understood that the endpoints of the given range are included in that range.

In one preferred and non-limiting embodiment or aspect, and with reference to FIGS. 1-7, a projectile 10 includes a heel portion 12 at a proximal end 14 of the projectile 10, a nose portion 16 at a distal end 20 of the projectile 10, and a body portion 18 extending between the heel portion 12 and the nose portion 16. It is to be understood that the drawings may not represent the exact relative dimensions of each portion of the projectile 10 and may not be drawn to scale. It is also to be understood that the drawings do not show every embodiment of the projectile 10 herein described, but show only exemplary embodiments.

Figure 2:
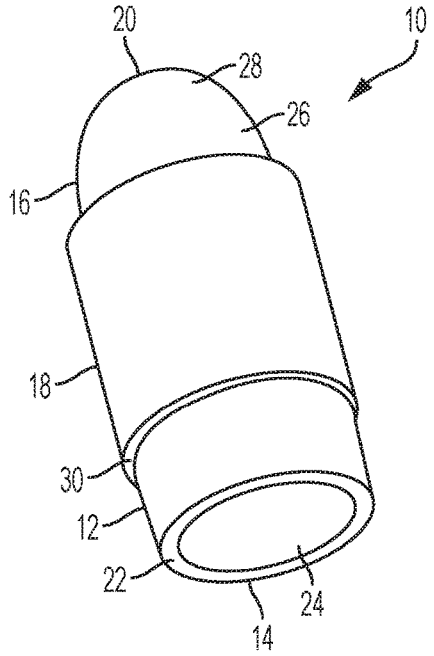
FIG. 2 is a bottom perspective view of the projectile of FIG. 1.
Figure 3:
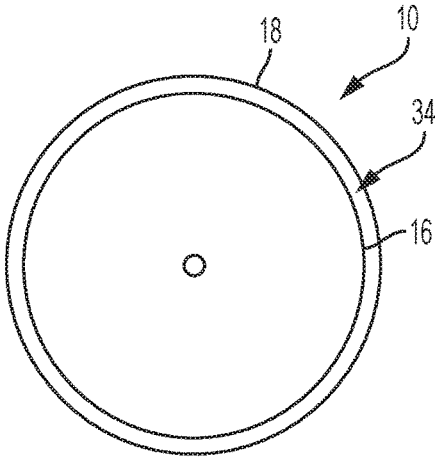
FIG. 3 is a top view of the projectile of FIG. 1.
Figure 4:
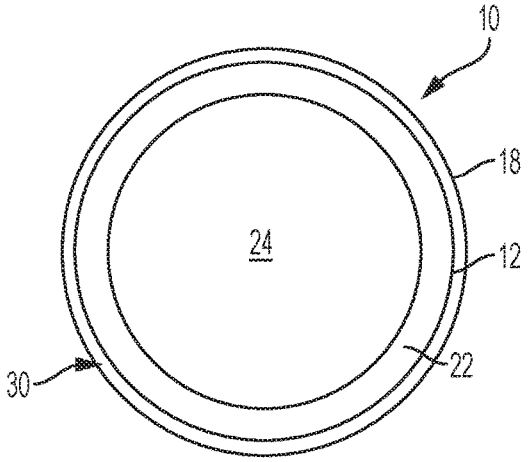
FIG. 4 is a bottom view of the projectile of FIG. 1.
Figure 7:
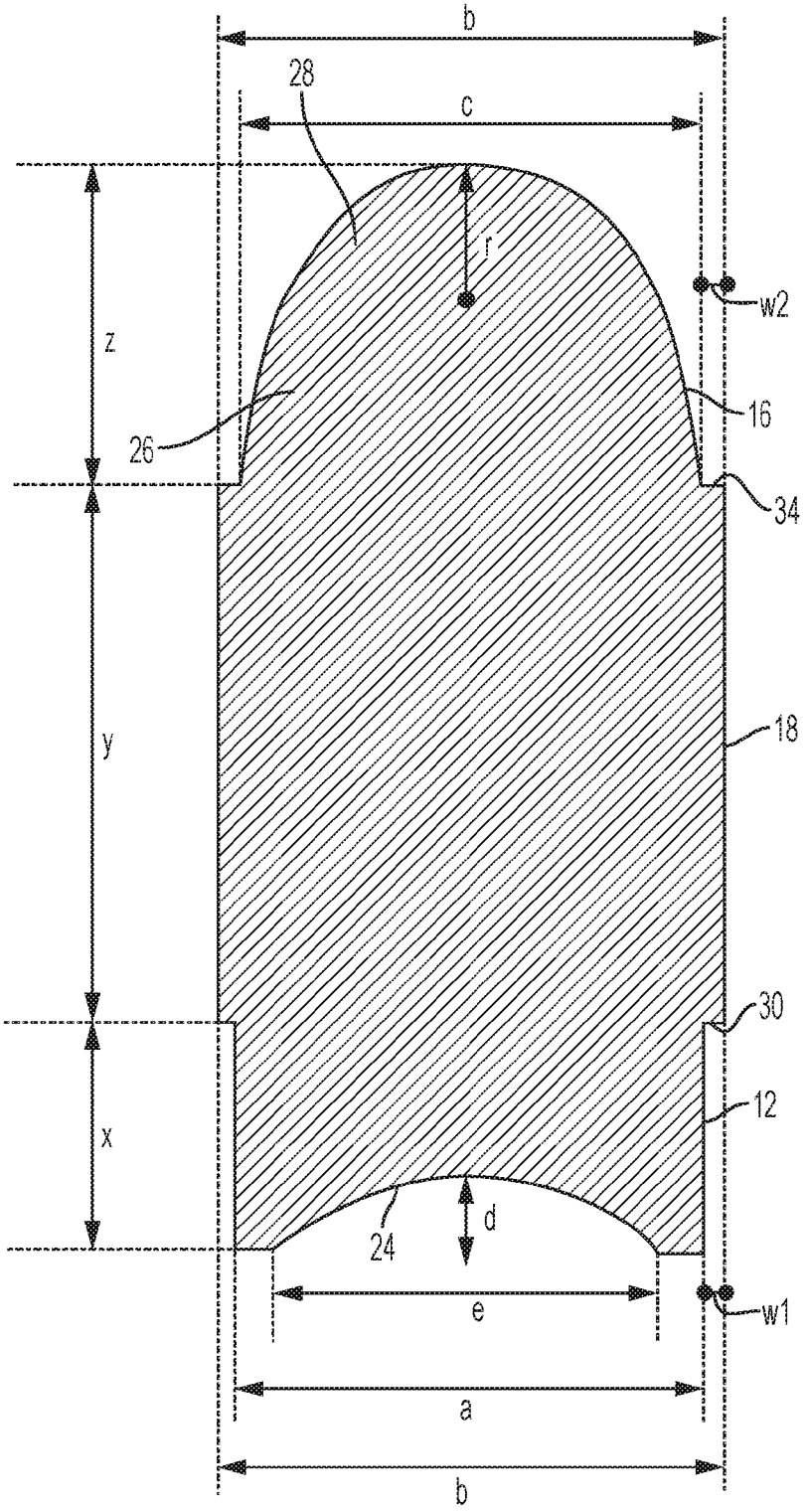
FIG. 7 is a cross-section of the projectile of FIG. 1 along line 7-7 in FIG. 5.

Referring to FIGS. 2, 4, and 7, the heel portion 12 can be substantially in the shape of a cylinder. The heel portion 12 has a diameter (third diameter). In one preferred and non-limiting embodiment or aspect, the heel portion 12 has a first end adjacent to the body portion 18 and a second end at the proximal end 14 of the projectile 10. The second end of the heel portion 16 terminates in a base 22, and a depression 24 is formed in the base 22 at the second end of the heel portion 16. The depression 24 can have a substantially concave (or smooth and/or rounded) surface extending into the heel portion 12 of the projectile 10 and can be centered within the base 22, such that the center of the depression 24 corresponds to a longitudinal axis of the projectile 10.

A maximum depth (d) of the depression 24 can be 10% to 50% of a length (x) of the heel portion 12, and preferably can be 20% to 25% of the length (x) of the heel portion 12. For example, the maximum depth (d) of the depression 24 can be 33% of the length (x) of the heel portion 12. The maximum depth (d) of the depression 24 can be less than a length (z) of the nose portion 16. The maximum depth (d) of the depression 24 can be 40% to 135% of the length (z) of the nose portion 16, and preferably, the maximum depth (d) of the depression 24 can be 45% to 130% of the length (z) of the nose portion 16.

A maximum diameter (e) of the depression 24 can be at least 33% of a maximum diameter (a) of the heel portion 12, and preferably can be 75% to 90% of the maximum diameter (a) of the heel portion 12. For example, the maximum diameter (e) of the depression 24 can be 80% of the maximum diameter (a) of the heel portion 12.

In one preferred and non-limiting embodiment or aspect, the depression 24 facilitates accurate discharge and/or travel of the projectile 10 when the projectile 10 is explosively discharged from a firearm.

In one preferred and non-limiting embodiment or aspect, and with reference to FIGS. 1-3 and 5-7, the nose portion 16 has a shape comprising two portions: a tapered proximal portion 26 and a rounded distal portion 28. The tapered proximal portion 26 can be substantially the shape of a truncated cone. The tapered proximal portion 26 can have a maximum diameter (a first diameter) at its proximal end where the nose portion 16 connects to the body portion 18 of the projectile 10 and a minimum width at its distal end 20 where it meets the rounded distal portion 28. The rounded distal portion 28 can be substantially the shape of a hemisphere (as in FIG. 7) having a radius (r) that is 30% to 60% of the length (z) of the nose portion 16, and preferably 35% to 45% of the length (z) of the nose portion 16. For example, the radius (r) can be 45% of the length (z) of the nose portion 16.

Figure 8:
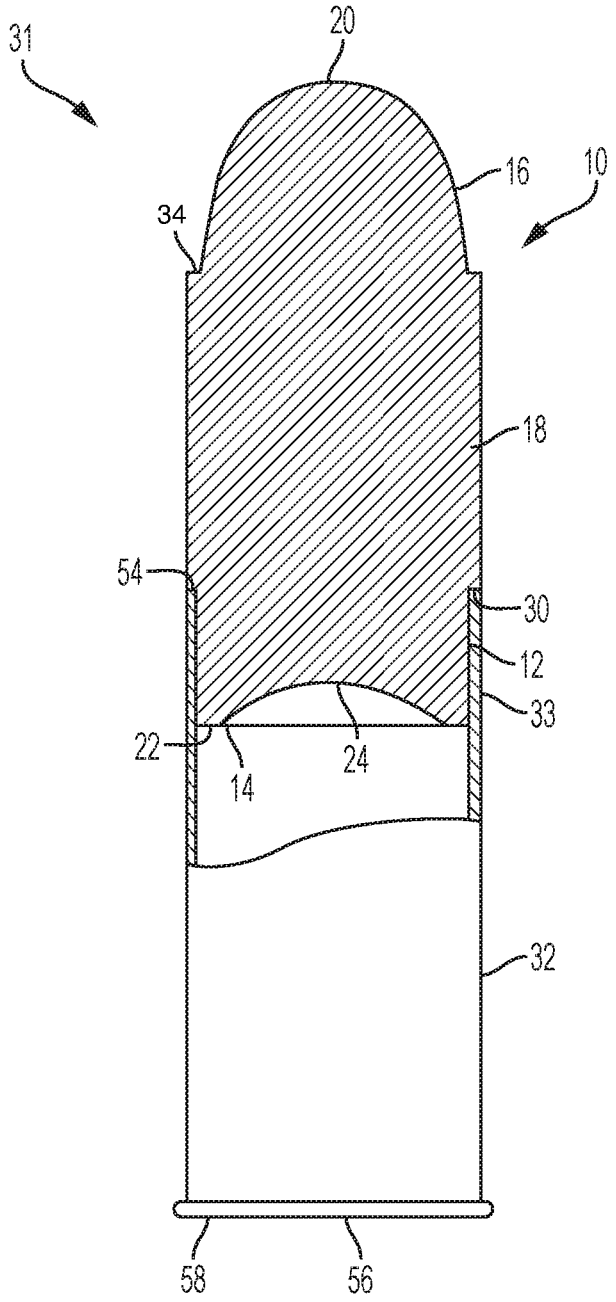
FIG. 8 is a sectional view of a rimfire ammunition according to the principles of the present invention, including a sectional view of a cartridge casing and a sectional view of the rimfire projectile along line 7-7 of FIG. 5.

Referring to FIGS. 1, 2, 5, 6, and 7, and in one preferred, non-limiting embodiment or aspect, the body portion 18 can have a substantially cylindrical shape having a diameter a second diameter). The body portion 18 can be outwardly stepped relative to the heel portion 12 to form a shoulder 30 between the heel portion 12 and the body portion 18. As shown in FIG. 8, the shoulder 30 can be formed to engage an upper edge of a cartridge casing, such that the heel portion 12 can be disposed within the cartridge casing 32 while the body portion 18 remains outside of the cartridge casing 32. The maximum diameter (a) of the heel portion 12 can be 1% to 20% smaller than a maximum diameter (b) of the body portion 18, and preferably the maximum diameter (a) of the heel portion 12 can be 5% to 15% smaller than the maximum diameter (b) of the body portion 18. For example, the maximum diameter (a) of the heel portion 12 can be 3% smaller than the maximum diameter (b) of the body portion 18.

In one preferred and non-limiting embodiment or aspect, the body portion 18 can be outwardly stepped relative to the nose portion 16 to form a shoulder 34 between the nose portion 16 and the body portion 18. However, in some embodiments, no shoulder 34 is present. A maximum diameter (c) of the nose portion 16 can be 0% to 30% smaller than the maximum diameter (b) of the body portion 18, preferably the maximum diameter (c) of the nose portion 16 can be 1% to 30% smaller than the maximum diameter (b) of the body portion (18), and more preferably the maximum diameter (c) of the nose portion 16 can be 10% to 20% smaller than the maximum diameter (b) of the body portion 18. For example, the maximum diameter (c) of the nose portion 16 can be 15% smaller than the maximum diameter (b) of the body portion 18.

In one preferred and non-limiting embodiment or aspect, the shoulder 30 between the heel portion 12 and the body portion 18 can have a width (w1) that is smaller than a width (w2) of the shoulder 34 between the nose portion 16 and the body portion 18. In one preferred and non-limiting embodiment or aspect, the length (x) of the heel portion 12 can be less than a length (y) of the body portion 18 and the length (z) of the nose portion 16. The length (x) of the heel portion 12 can be 10% to 30% of the length (y) of the body portion 18, and preferably the length (x) of the heel portion 12 can be 15% to 25% of the length (y) of the body portion 18. The length (x) of the heel portion 12 can be less than the length (z) of the nose portion 16. The length (x) of the heel portion 12 can be 60% to 80% of the length (z) of the nose portion 16, and preferably, the length (x) of the heel portion 12 can be 65% to 75% of the length (z) of the nose portion 16. For example, the length (x) of the heel portion 12 can be 70% of the length (z) of the nose portion 18.

Figure 5:
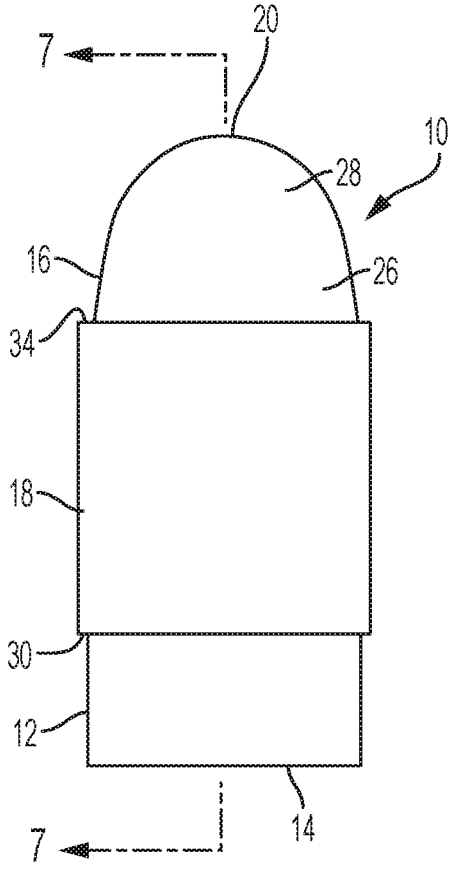
FIG. 5 is a side view of the projectile of FIG. 1.
Figure 6:
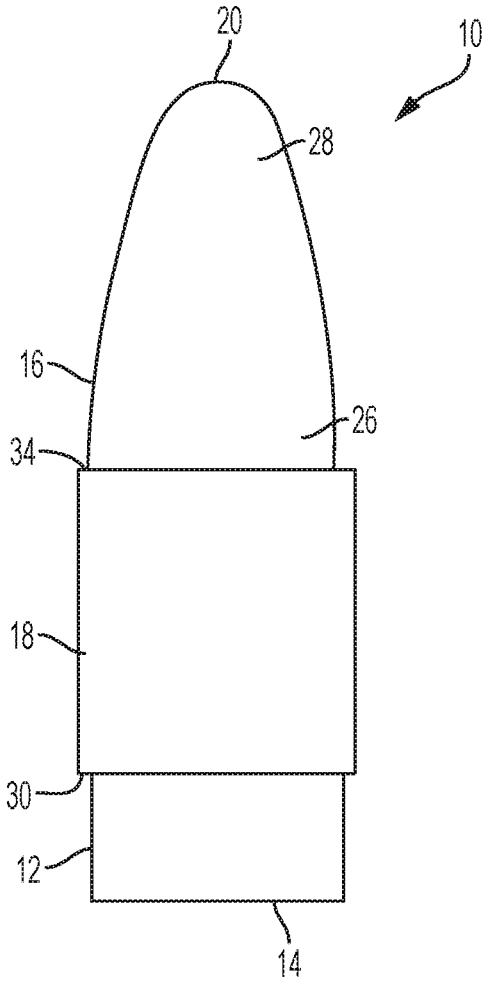
FIG. 6 is a side view of another embodiment of a projectile according to the principles of the present invention.

In one preferred and non-limiting embodiment or aspect, the length (z) of the nose portion 16 can be less than the length (y) of the body portion, as shown in FIGS. 1-2, 5, and 7. In other embodiments, the length (z) of the nose portion 16 can be greater than the length (y) of the body portion 18, as shown in FIG. 6. In a preferred, non-limiting embodiment or aspect, the length (z) of the nose portion 16 can be 90% to 220% of the length (y) of the body portion 18, and preferably the length (z) of the nose portion 16 can be 100% to 205% of the length (y) of the body portion 18. FIG. 5 shows an embodiment of the projectile with the length (z) of the rounded nose portion 16 shorter than the length (y) of the body portion 18. FIG. 6 shows an embodiment of the projectile with the length (z) of the rounded nose portion 16 longer than the length (y) of the body portion 18.

With continued reference to FIGS. 1-7, in one preferred and non-limiting embodiment or aspect, the projectile 10 can be formed from a metal, such as copper, or an alloy, such as a copper-based alloy. The copper-based alloy can be predominately composed of copper and can include one or more additional elements including, but not limited to, tin, zinc, aluminum, manganese, silicon, and combinations thereof. The copper-based alloy can be, for example, brass (Cu—Zn) or bronze (Cu—Sn). The material can be lead-free. Lead-free as used herein means an alloy containing less than 1 weight % lead, based on the total weight of the projectile 10, such as less than 0.75 weight % lead, such as less than 0.5 weight % lead, such as less than 0.25 weight % lead, such as 0 weight % lead. Or, in some cases, the projectile 10 can include up to 1 weight percent % lead, based on the total weight of the projectile 10, such as 0.25 weight % lead, such as 0.5 weight % lead, such as 0.75 weight % lead.

In one preferred and non-limiting embodiment or aspect, the material used to produce the projectile 10 is in the form of a powdered material comprising from 80-95 weight % Cu, from 5-15 weight % Sn, and from 0.25-2 weight % wax lubricant, preferably from 90-95 weight % Cu, from 5-10 weight % Sn, and from 0.5-1 weight % wax lubricant, and more preferably from 90-91 weight % Cu, from 8-11 weight % Sn, and from 0.5-0.75 weight % wax lubricant, based on the total weight of material used to form the projectile 10. The wax lubricant can be, for instance, wax-based atomized lubricant. The wax lubricant can be "Awax" lubricant. The material can, in some cases, include other additives such as chemical compounds, polymeric compounds, other lubricants, and binders.

In one preferred and non-limiting embodiment or aspect, the material used to produce the projectile 10 can comprise 90 weight % copper, 9.5 weight % tin, and 0.5 weight wax-based lubricant, based on the total weight of the material used to produce the projectile 10. The resulting projectile 10 can comprise 89-90 weight % Cu and 9.5-10 weight % Sn, based on the total weight of the resulting projectile 10. In one preferred and non-limiting embodiment or aspect, the resulting projectile 10 is made up of 90 weight % Cu and 10 weight % Sn, based on the total weight of the resulting projectile 10. In this embodiment or aspect, the copper-tin projectile 10 microstructure can be a matrix of copper particles with partially diffused tin particles binding the copper together.

In one preferred and non-limiting embodiment or aspect, the projectile 10 can have a density of 7.0-8.0 g/cm$^3$. The projectile can include copper and tin. The projectile 10, such as the copper-tin projectile 10 having a density in this range gives the projectile 10 the necessary green strength to produce the above-described, desired, advantageous shapes of the projectile 10. Densities that are too low can result in the nose portion 16 to not release from a tooling 35 (described below) used to form the projectile 10. Densities that are too high can require forces that cause the tooling 35 to break. In one preferred and non-limiting embodiment or aspect, the projectile 10 is frangible. In one preferred, non-limiting embodiment or aspect, the resulting projectile 10 is configured to fit in a rimfire cartridge casing 32 of a rimfire ammunition 31.

Referring to FIG. 8, a cross-sectional view of rimfire ammunition 31 according to one preferred and non-limiting embodiment or aspect, including a cross-sectional view of a cartridge casing 32 and the rimfire projectile 10 along line 7-7 of FIG. 5, is shown. According to FIG. 8, rimfire ammunition 31 of an exemplary embodiment can include a projectile 10, a cartridge casing 32, and a priming compound (not shown). The ammunition is referred to as "rimfire" ammunition 31 because the firing pin of the gun firing the rimfire ammunition 31 strikes a rim 58 of a closed bottom end 56 of the cartridge casing 32 to ignite the priming compound to explosively discharge the projectile 10. The cartridge casing 32 can include an open top end 54 and a closed bottom end 56. The projectile 10 can be inserted into the open top end 54 and the priming compound can be provided within the closed bottom end 56.

In one preferred and non-limiting embodiment or aspect, the maximum diameter (b) of the body portion 18 of the projectile 10 can be greater than an inner diameter of the cartridge casing 32 to prevent insertion of the body portion 18 therein. Preferably, the maximum diameter (b) of the body portion 18 substantially corresponds to the outer diameter of the cartridge casing 32, such that an outer surface of the body portion 18 is substantially flush with an outer surface of the cartridge casing 32 (as shown in FIG. 8). In such a configuration, the width (w1) of the shoulder 30 between the body portion 18 and the heel portion 12 of the projectile 10 is equal to the thickness of a sidewall 33 of the cartridge casing 32. The maximum diameter (a) of the heel portion 12 of the projectile 10 is equal to or less than the inner diameter of the cartridge casing 32. Thus, the heel portion 12 of the projectile 10 can be disposed within the cartridge casing 32 while the body portion 18 can remain outside the cartridge casing 32. The cartridge casing 32 can additionally include the rim 58 at the closed bottom end 56 of the cartridge casing 32. The priming compound can be provided inside the rim 58 to explosively discharge the projectile 10 when the rim 58 is struck by the firing pin of a firearm.

In one preferred and non-limiting embodiment or aspect, the projectile 10 can be formed by a method that includes compressing and sintering powdered material into the shape of the projectile 10.

FIGS. 9-13 illustrate the steps used to make the projectile 10 in one preferred and non-limiting embodiment or aspect of a method. The steps include compressing and sintering a powdered material 52 into the shape of the projectile 10. The powdered material 52 can comprise a metallic powder component, which can include a metal, an alloy, or a combination thereof. The metallic component can be copper or a copper-based alloy. The copper-based alloy can be predominately composed of copper and can include one or more additional elements including, but not limited to, tin, zinc, aluminum, manganese, silicon, iron, and combinations thereof. The copper-based alloy can be, for example, brass (Cu—Zn) or bronze (Cu—Sn). The metallic component can be lead free. Lead-free as used herein means an alloy containing less than 1 weight % lead, based on the total weight of the projectile, such as less than 0.75 weight % lead, such as less than 0.5 weight % lead, such as less than 0.25 weight % lead, such as 0 weight % lead. Or, in some cases, the projectile can include up to 1 weight percent % lead, based on the total weight of the projectile, such as 0.25 weight % lead, such as 0.5 weight % lead, such as 0.25 weight % lead.

In one preferred and non-limiting embodiment or aspect, the powdered material 52 can be a premixed mixture of metallic powder components, such as copper-zinc powder. The powdered material 52 can also be made by combining separate metallic powders, such as mixing copper powder and zinc powder. The particle size of the metallic component can be of any size appropriate to yield the end characteristics of the projectile 10. In one preferred and non-limiting embodiment or aspect, the particle size range of the metallic component particles is 10-300 μm. In one non-limiting embodiment or aspect, the powdered material 52 is made by combining the desired ratio of copper powder and zinc powder and blending the two powders together to form a uniform mixture of the copper powder and zinc powder. In one preferred and non-limiting embodiment or aspect, the copper powder and zinc powder are blended using a v-shaped blender for 20-30 minutes. Similar mixtures of other metallic powders (i.e., other than copper powder with zinc powder) can be blended together using an analogous process to form the powdered material 52. In other processes, the powdered material 52 can comprise only one powdered metallic component, such as only copper powder.

In one preferred and non-limiting embodiment or aspect, the powdered material 52 can further include a lubricant. The amount of lubricant included in the powdered material can be varied to result in the projectile 10 having desired end properties. In some embodiments, the lubricant is a wax-based lubricant. Examples of lubricants can include, but are not limited to, acrowax, zinc sterate, and lithium sterate. In a preferred, non-limiting embodiment or aspect, the lubricant is also a powder, such as a wax-based atomized lubricant. Therefore, one preferred, non-limiting embodiment includes a powdered material 52 having the desired ratio of copper powder, zinc powder, and a wax-based atomized lubricant, which is blended for 20-30 minutes in a v-shaped blender. The powdered material 52 can also include other additives. Other additives can include chemical compounds, polymeric compounds, and binders.

With continued reference to FIGS. 9-13, and in one preferred and non-limiting embodiment or aspect, the tooling 35 to manufacture the projectile 10 includes a die 36, a lower punch 38, and an upper punch 40. The die 36 defines an interior passageway 42 leading from an upper surface 44 of the die 36 to a lower surface 46 of the die 36. The interior passageway 42 can be substantially cylindrical in the case that portions of the projectile 10 are designed to be cylindrical.

Figure 10:
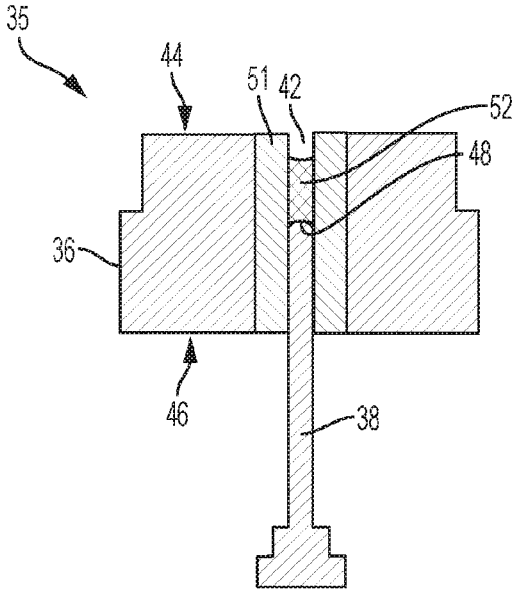
Figure 11:
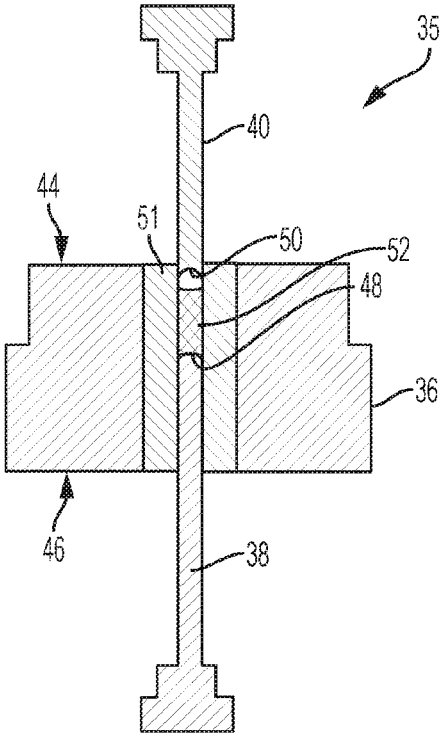
Figure 12:
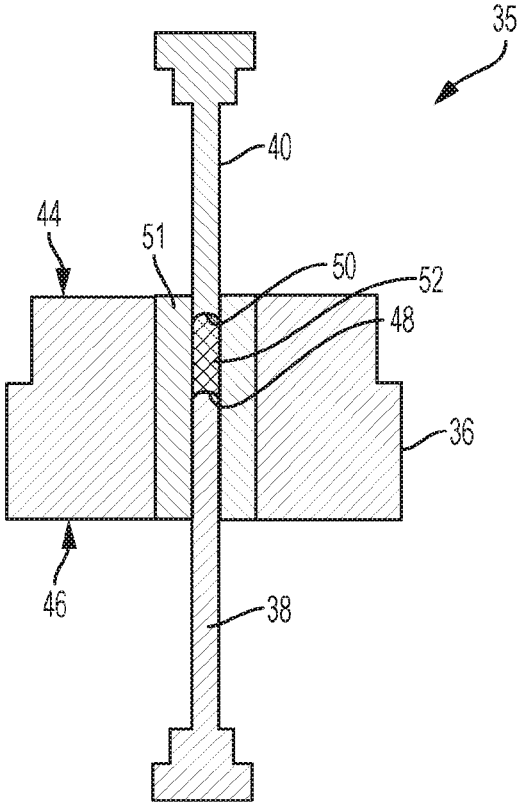
Figure 13:
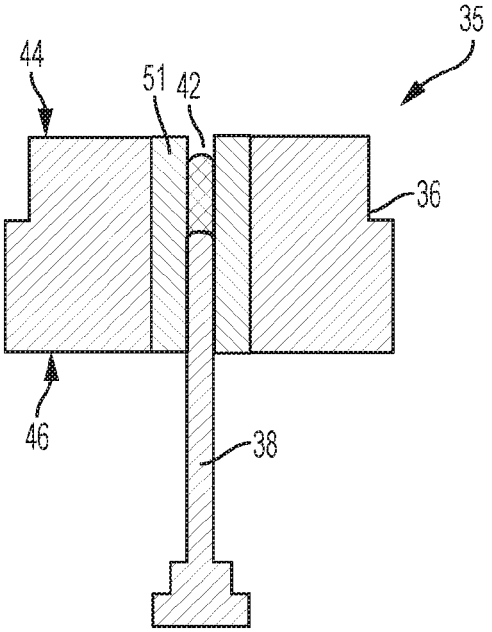
Figure 14:
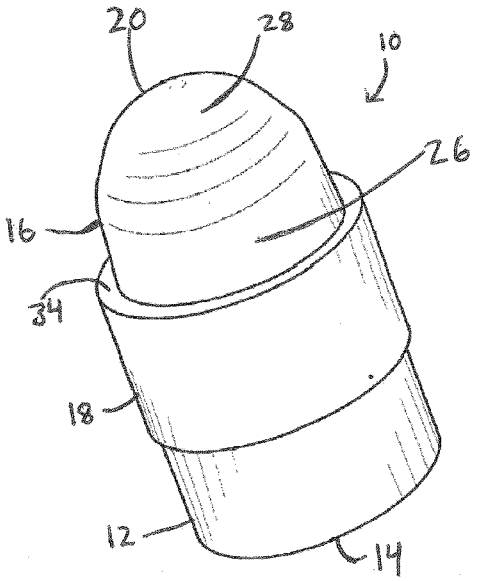
FIG. 14 is a top perspective view of a projectile according to the principles of the present invention.
Figure 15:
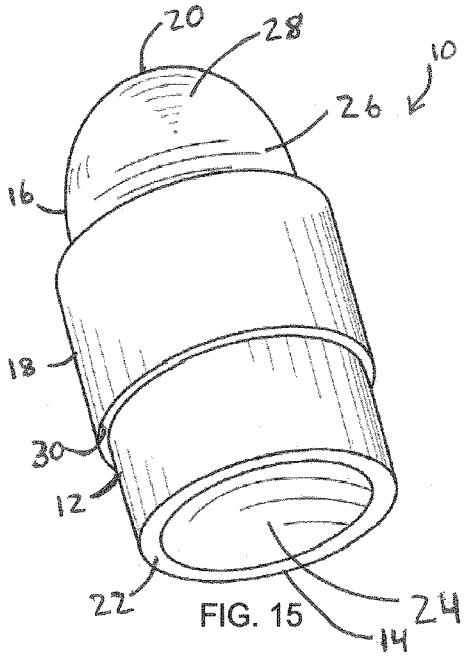
FIG. 15 is a bottom perspective view of the projectile of FIG. 14.
Figure 16:
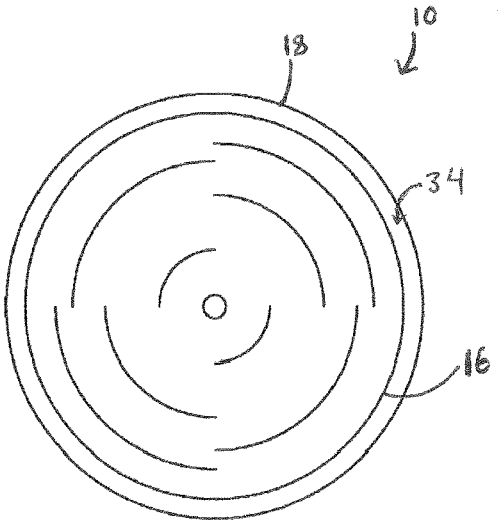
FIG. 16 is a top view of the projectile of FIG. 14.
Figure 17:
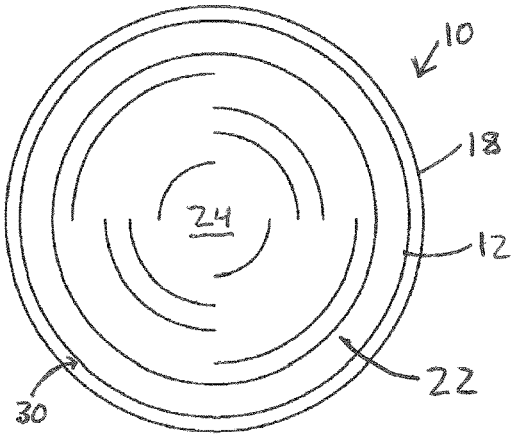
FIG. 17 is a bottom view of the projectile of FIG. 14.
Figure 18:
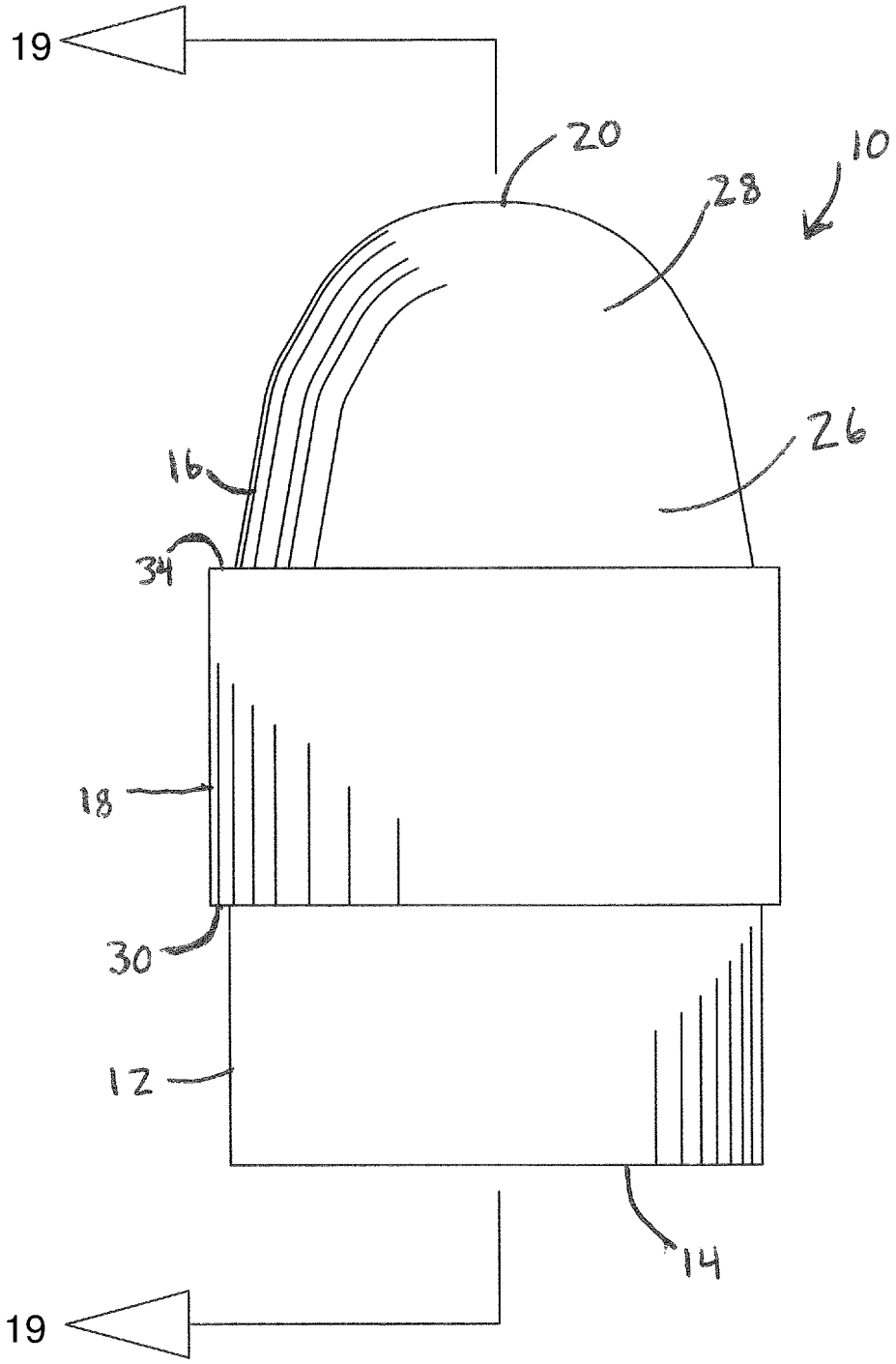
FIG. 18 is a side view of the projectile of FIG. 14.
Figure 19:
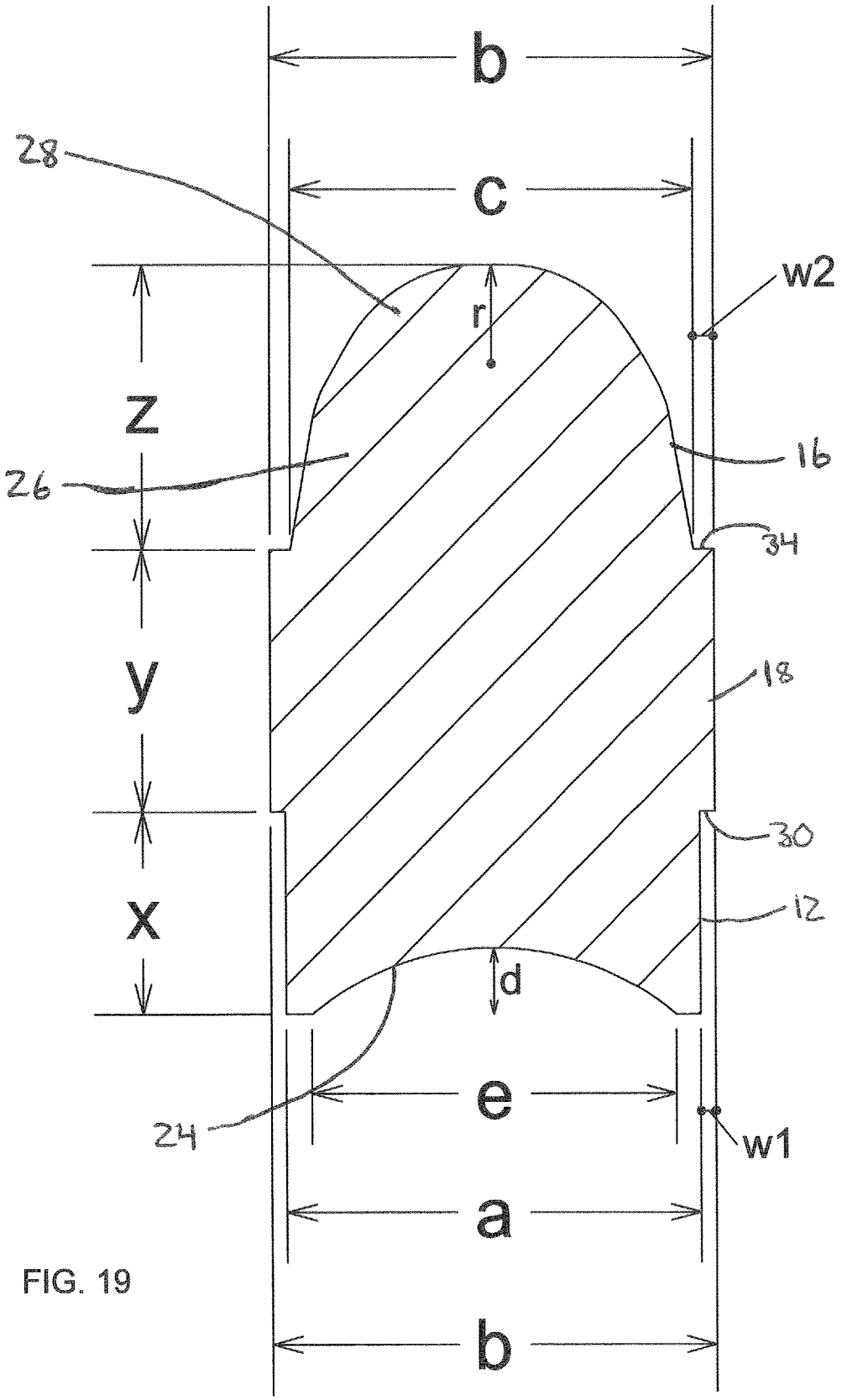
FIG. 19 is a cross-section of the projectile of FIG. 14 along line 19-19 in FIG. 18.
Figure 20:
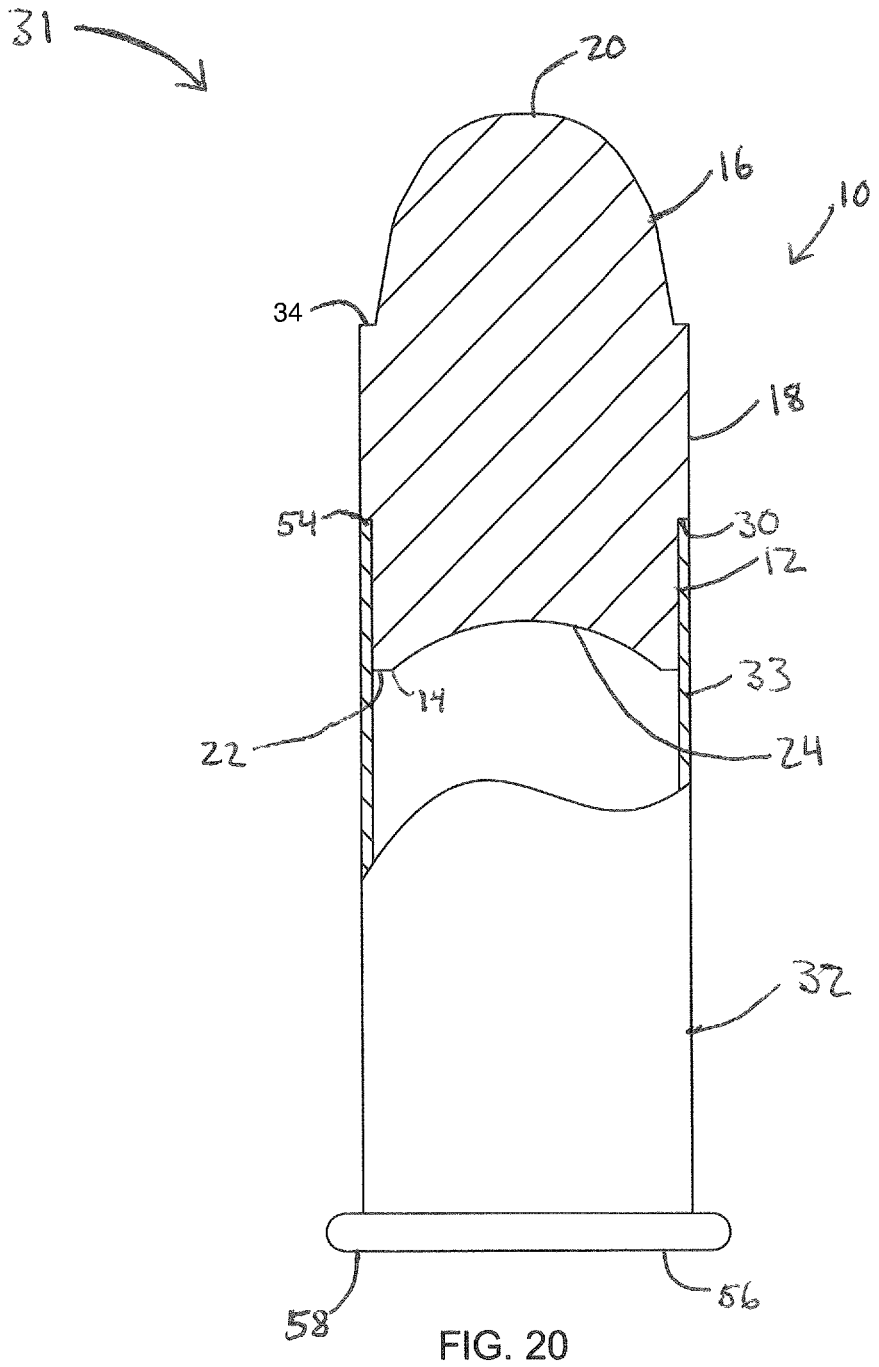
FIG. 20 is a sectional view of a rimfire ammunition according to the principles of the present invention, including a sectional view of a cartridge casing and a sectional view of the rimfire projectile along line 19-19 of FIG. 18.

In one preferred and non-limiting embodiment or aspect, the lower punch 38 can have a substantially convex-shaped upper surface 48 in the case that the heel portion 12 of the projectile 10 is designed to terminate in a base 22 having a depression 24 therein, as previously described. The shape of the convex-shaped upper surface 48 of the lower punch 38 can generally correspond to the desired shape of the depression 24. The lower punch 38 can be positioned in the interior passageway 42. Within the interior passageway 42, the lower punch 38 can be movable between a first position and a second position. In the first position, the lower punch 38 is positioned lower in the interior passageway 42, and in the second position, the lower punch 38 is positioned higher in the interior passageway 42. For instance, FIGS. 9-11 show the lower punch 38 in the first position, and FIGS. 12-13 show the lower punch 38 in the second position.

In one preferred and non-limiting embodiment or aspect, the upper punch 40 can have a concave-shaped lower surface 50 that generally corresponds to the shape of the nose portion 16 of the projectile 10. The upper punch 40 can be movable between a first position and a second position. In the first position, the upper punch 40 can be outside of the interior passageway 42. In the second position, the upper punch 40 can be at least partially inside the interior passageway 42. The portion of the upper punch 40 inside the interior passageway 42 in the second position can be at least the concave-shaped lower surface 50. FIGS. 11-12 show the upper punch 40 in this second position. In one preferred and non-limiting embodiment or aspect, the tooling 35 is produced by construction of an upper punch 40 and lower punch 38 formed from S7 tool steel and a die 36 formed from 4140 semi-hard steel, with a hardened CPM-10v insert 51 lining the inner surface of the interior passageway 42.

Figure 9:
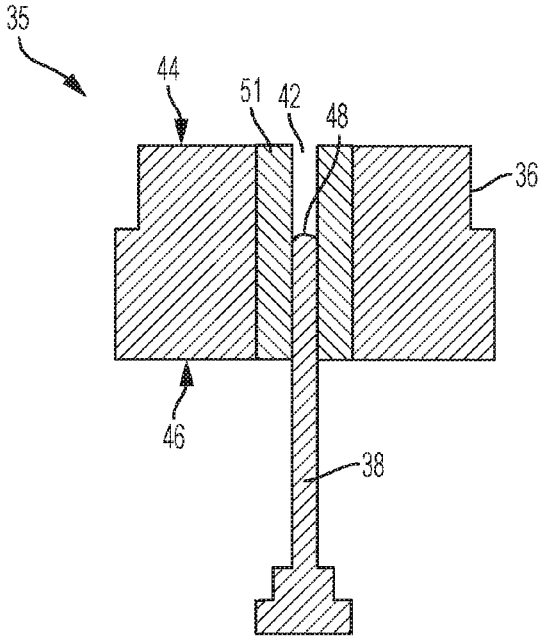
FIGS. 9-13 illustrate certain steps in a method of manufacturing a projectile according to the principles of the present invention.

In one preferred and non-limiting embodiment or aspect, and as shown in FIG. 9, prior to the introduction of the powdered material 52 into the interior passageway 42 of the die 36, the lower punch 38 can be set at a first position within the interior passageway 42 of the die 36 to form a bottom surface that constrains the powdered material 52 at a predetermined height within the interior passageway 42. The upper punch 40 can be set in the first position as well. After the lower punch 38 has been positioned in the interior passageway 42 in the first position, the previously-described powdered material 52 can be added to the interior passageway 42 through the opening in the upper surface 44 of the die 36 as shown in FIG. 10. The weight of the powdered material 52 added to the interior passageway 42 can correspond to the desired weight of the projectile 10. As shown in FIG. 11, the upper punch 40 can then be positioned in the die 36 at the second position within the interior passageway 42 of the die 36.

In one preferred, non-limiting embodiment or aspect, once the upper punch 40 enters the interior passageway 42, the lower punch 38 begins to move from the first position to the second position. In some embodiments, the lower punch 38 can move to the second position once the upper punch 40 reaches the second position other embodiments, the lower punch 38 can begin to move to the second position once the upper punch 40 enters the interior passageway 42, but before the upper punch 40 comes to a stop in the second position. In this scenario, the lower punch 38 can move upwards toward its second position at a faster rate than the rate of the upper punch 40 moving down toward its second position. In another preferred and non-limiting embodiment or aspect, the upper punch 40 and the lower punch 38 can begin to move from their respective first positions to their respective second positions at substantially the same time. Raising the lower punch 38 to the second position can drive the powdered material 52 into the concave lower surface 50 of the upper punch 40 (FIG. 12). The lower punch 38 can provide most of the pressing force. If the upper punch 40 were lowered into the powdered material 52 instead of raising the lower punch 38 to drive the powdered material 52 into the upper punch 40, then the perimeter portions of the lower surface of the upper punch 40 would compact the powdered material 52, thereby causing the compacted portion of the powdered material 52 to bind together and limit the continuing ability of the powdered material 52 to flow into the concave lower surface 50 of the upper punch 40 resulting in an ill-formed nose portion 16 of the projectile 10. However, by raising the lower punch 38 to drive the powdered material 52 into the upper punch 40, the powdered material 52 near the concave lower surface 50 of the upper punch 40 is not prematurely bound together, detrimentally limiting the ability of the powdered material 52 to flow into the concave lower surface 50 in the upper punch 40 to form the nose portion 16 of the projectile 10.

After this step, and in one preferred and non-limiting embodiment or aspect, the lower punch 38 and the upper punch 40 can be simultaneously moved toward one another to their final molding heights in order to compress the powdered material 52 together, thereby forming a compacted powder projectile 10 with a desired length. During this step, 10-60 tons per square inch of pressure can be applied to the powdered material 52, preferably 30-45 tons per square inch of pressure is applied, and more preferably, 40-45 tons per square inch of pressure can be applied. For example, 35 tons per square inch of pressure can be applied to the powdered material 52. Once the projectile 10 is formed to the final molding height, the upper punch 40 can be moved to the first position (i.e., removed from the interior passageway 42). The lower punch 38 can be further raised to drive the formed projectile 10 from the die 36 (FIG. 13).

For purposes of the following discussion, a single melting point material is a material whose solidus and liquidus is the same temperature. An example of a single melting point material is a pure metallic element. The solidus of a material is a temperature for which the material first liquifies. In particular, below this temperature, the material is a solid and no liquid is present. Between the solidus and liquidus states, there is a "slushy" state, which becomes more liquid as it approaches the liquidus. This slushy state is observed in the melting of many alloys. According to the prior art, it is in this temperature range above the solidus that liquid phase sintering occurs. Liquid phase sintering can be further broken down into many sub-groups, such as supersolidus sintering and true liquid phase sintering, however all subcategories of liquid phase sintering occur above the solidus temperature.

The liquidus is the temperature for a material at which there is complete liquid, without any solids present. Above this temperature, melt processing occurs, such as casting. A system may be considered a two-material system with high and low melting constituents, in which the low melting point metal has its own single melting point or solidus-liquidus range, and yet another solidus-liquidus range for a solution of the two metals.

A solid solution is generally considered a material with solid particles that have dissolved in a lower melting point matrix metal. The matrix dissolves the solid particles, which go into solution. Depending upon several factors, such as the amount of each metal, dwell-time at the temperature, oxide level present, processing temperature, cooling rate, etc., the solid particles may remain very small or may precipitate and grow into larger grains.

The formed projectile 10 ejected from the die 36 can be subjected to a sintering process. The sintering process can be conducted at a variety of temperatures, for a variety of durations, and in a variety of atmospheres depending on a number of factors including, but not limited to, the materials used to make the projectile 10, the desired final characteristics of the projectile 10, such as the desired strength of the projectile 10, and the intended use of the projectile 10.

In certain preferred and non-limiting embodiments or aspects, the sintering step is a liquid phase sintering process. The liquid phase sintering process can be performed at a temperature at least above the solidus of one of the materials. In one contemplated liquid phase sintering process performed on a projectile 10 comprising at least two metallic components (e.g. formed from a mixture of blended metallic powders as described above), bonding occurs as the temperature is elevated above the eutectic temperature of two materials and a temporary liquid is formed. As soon as the liquid forms, it alloys with the other metal and the melting point rises such that there is no longer liquid. The result is light metal-to-metal bonding that relies on the small, weak, and brittle intermetallic compounds that form at the contact points of the particles as a result of passing through the eutectic temperature. Several variants of the above sintering process can be used with the same goal of brittle bonding to achieve a frangible projectile 10. In one preferred and non-limiting embodiment or aspect, a projectile 10 made from copper powder and tin powder is subjected to liquid phase sintering. In this embodiment or aspect, the resulting copper-tin projectile 10 has a microstructure that is a matrix of copper particles with partially diffused tin particles binding the copper together.

Other embodiments can utilize a sintering step that is a solid state sintering process. For instance, a solid state sintering process can be used for a projectile 10 made of pre-alloyed materials or elemental materials, such as copper alone. In one embodiment of the solid state sintering process, the sintering process occurs at a temperature below the solidus of the constituent materials. Specifically, particles form bonds along the regions that have been forced into close contact during pressing or compacting of these particles. Bonding occurs by atoms moving into the vacancies between particle boundaries. However, the particles are essentially the same size and shape before and after the sintering process. Dimensional changes of the compacted mixture are small. In addition, no liquid metal is present at any stage during the solid state sintering process. During the solid state sintering process, neutral or slightly reducing atmospheres can be used, since the oxide layer on the outside of the powdered particles is mechanically smeared during the pressing operation which prepares the metal in these regions for sinter bonding. Other sintering processes, or variants on the above-described sintering processes, can be used to yield a projectile 10 with the desired end properties.

In certain preferred and non-limiting embodiments or aspects, the projectile 10 can be formed from a powdered material 52 including both a powdered metallic component and a powdered wax-based lubricant. For instance, in one preferred, non-limiting embodiment or aspect, the projectile 10 is formed from a powdered material 52 having copper powder, tin powder, and a wax lubricant, such as a wax-based atomized lubricant. In one such embodiment or aspect, the powdered material 52 used to produce the projectile 10 can comprise 90 weight % copper, 9.5 weight % tin, and 0.5 weight % wax lubricant, based on the total weight of powdered material 52 used to produce the projectile 10, blended together in a v-shaped blender for 20-30 minutes. In some embodiments, the lubricant is burned off during the sintering process so that the resulting projectile 10 (after sintering) comprises substantially no lubricant. Substantially no lubricant means less than 0.2 weight % lubricant based on total weight of the projectile 10 after sintering, such as less than 0.1 weight % lubricant, such as less than 0.05 weight % lubricant, such as 0 weight % lubricant. Therefore, the projectile 10 that can result from the above-described embodiment can comprise 89-90 weight % Cu and 9.5-10 weight % Sn, based on the total weight of the resulting projectile 10.

Referring to FIGS. 14-20, and in one preferred and non-limiting embodiment or aspect, the projectile 10 having the nose portion 16, the body portion 18, and the heel portion 12 can have the relative shape and relative dimensions previously described. In this particular embodiment, the length (z) of the nose portion 16 is greater than the length (y) of the body portion 18. In some preferred and non-limiting embodiments or aspects, the relative length (z) of the nose portion 16 can be even longer than the length (v) of the body portion, compared to the embodiment shown in FIGS. 14-20. In other words, there can be a greater length disparity between the length (z) of the nose portion 16 as compared to the length (y) of the body portion.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

What is claimed is:

1. A projectile comprising:

a nose portion comprising a tapered proximal portion and a rounded distal portion, an end of the tapered proximal portion having a first diameter;

a body portion substantially cylindrical in shape having a second diameter, wherein a first end of the body portion is adjacent to the tapered proximal portion of the nose portion;

a heel portion substantially cylindrical in shape having a third diameter, wherein a first end of the heel portion is adjacent to a second end of the body portion, wherein the second diameter is greater than the third diameter; and a depression defined in a second end of the heel portion, wherein the projectile comprises particles of a first metal and particles of a second metal and the particles of the first metal are bonded to the particles of the second metal by intermetallic compounds comprising the first metal and the second metal.

2. The projectile of claim 1, wherein the projectile is lead-free.

3. The projectile of claim 1, wherein the first metal is copper.

4. The projectile of claim 1, wherein the second metal is zinc or tin.

5. The projectile of claim 1, wherein the projectile comprises 89-90 weight % copper and 9.5-10 weight % tin, based on the total weight of the projectile.

6. The projectile of claim 1, wherein the projectile has a density of 7-8 g/cm$^3$.

7. The projectile of claim 1, wherein a maximum depth of the depression is 40-135% of a length of the nose portion.

8. The projectile of claim 1, wherein a maximum diameter of the depression is at least 33% of the third diameter.

9. The projectile of claim 1, wherein the first diameter is 1-30% smaller than the second diameter.

10. The projectile of claim 1, wherein the third diameter is 1-20% smaller than the second diameter.

11. The projectile of claim 1, wherein a length of the heel portion is 10-30% of a length of the body portion.

12. The projectile of claim 1, wherein a length of the nose portion is 90-220% of a length of the body portion.

13. The projectile of claim 1, wherein the particles of the first metal and the particles of the second metal have a particle size of 10-300 μm.

14. A projectile comprising:

a nose portion comprising a tapered proximal portion and a rounded distal portion, an end of the tapered proximal portion having a first diameter;

a body portion substantially cylindrical in shape having a second diameter, wherein a first end of the body portion is adjacent to the tapered proximal portion of the nose portion;

a heel portion substantially cylindrical in shape having a third diameter, wherein a first end of the heel portion is adjacent to a second end of the body portion, wherein the second diameter is greater than the third diameter; and a depression defined in a second end of the heel portion, wherein the projectile comprises metallic particles that are connected by bonds formed by compression, where the bonds are formed by atoms that have moved into the vacancies between particle boundaries.

15. The projectile of claim 14, wherein the projectile is lead-free.

16. The projectile of claim 14, wherein the metallic particles comprise copper or a copper-based alloy.

17. The projectile of claim 16, wherein the copper-based alloy comprises-zinc or tin.

18. The projectile of claim 14, wherein the projectile comprises 89-90 weight % copper and 9.5-10 weight % tin, based on the total weight of the projectile.

19. The projectile of claim 14, wherein the projectile has a density of 7-8 g/cm$^3$.

20. The projectile of claim 14, wherein the metallic particles have a particle size of 10-300 μm.

* * * * *